United States Patent [19]

Manning

[11] 3,989,346

[45] Nov. 2, 1976

[54] CONNECTOR HOUSING

[75] Inventor: Randy Marshall Manning, Millersburg, Pa.

[73] Assignee: AMP Incorporated, Harrisburg, Pa.

[22] Filed: Nov. 3, 1975

[21] Appl. No.: 628,440

[52] U.S. Cl. ..... 339/258 S

[51] Int. Cl.[2] ..... H01R 11/04

[58] Field of Search ..... 339/59–61, 339/200–204, 213, 256, 258

[56] References Cited

UNITED STATES PATENTS

| | | | |
|---|---|---|---|
| 2,206,471 | 7/1940 | Taylor | 339/59 R |
| 3,200,367 | 8/1965 | Blanchenot | 339/258 S |

FOREIGN PATENTS OR APPLICATIONS

| | | | |
|---|---|---|---|
| 743,256 | 9/1966 | Canada | 339/258 S |

*Primary Examiner*—Joseph H. McGlynn
*Attorney, Agent, or Firm*—William J. Keating; Donald W. Phillion

[57] ABSTRACT

A connector system having tab-like male terminal with stopping shoulders and a female terminal contained in a housing which has an opening for insertion of the male terminal into the female terminal. To provide needed electrical isolation for the female terminal in its unmated condition, the housing extends beyond the male tab receiving outer edge of the female terminal a predetermined distance $D_1$. Because of industry length standards for male tab terminals the shoulders thereon must abut against the outer edge of the female terminal for proper mating. Thin membranes, which are slitted, are formed in the housing to mate with the male tab shoulders and extend from the outer edge of the housing to a distance back of the outer edges of the female terminal to enable the male tab shoulders to push aside the slitted, thin membranes and abut against the outer edge of the female terminal.

17 Claims, 4 Drawing Figures

CONNECTOR HOUSING

BACKGROUND OF INVENTION

This invention relates generally to connector systems and more particularly to a connector system having male and mating female terminals with the female terminal contained in a housing which has a portion thereof extending beyond the opening of the contained female terminal to minimize accidental contact with the female terminal by external means when not connected to the mating male terminal.

In certain connectors the female terminals are enclosed in an insulative housing which is open at one end to receive a male terminal which mates with the female terminal. The depth of insertion of the male terminal into the female terminal is determined by shoulders formed on the male terminal, which shoulders are wide enough to span oppositely positioned walls at the open end of the housing and consequently will come to rest upon the open end of said housing when fully inserted in the female receptacle.

One safety limitation imposed by the Underwriters Laboratories upon certain connectors of the general type described above is that the degree of accessibility of the female terminal to a probe of a certain size and configuration, when the female terminal is not mated to the male terminal, be limited. Specifically, in order to meet UL standards, such a probe, when moved about within the open end of the housing, should not make contact with the female terminal contained therein. Prior art connectors of the type described generally above and comprising a housing with a female terminal contained therein and an opening for receiving a mating terminal, often do not meet such UL safety standards.

It has not proven to be a satisfactory answer to the problem of meeting UL standards by simply extending the housing beyond the open end of the female terminal a sufficient distance to meet the probe requirements since the portion of the male terminal which mates with the female terminal has standard lengths measured from the shoulders thereof. Such an extension of the housing walls merely results in insufficient insertion of the male terminal. On the other hand, if the housing wall is not extended sufficiently beyond the open end of the female terminal, then UL probe requirements are not met.

STATEMENT OF INVENTION

It is a primary object of the invention to provide a connector assembly of the type described above in which the housing containing the female terminal extends beyond the male terminal receiving opening thereof a sufficient distance to meet UL standards and yet permits full entry of the male terminal into the female terminal.

It is a second aim of the invention to provide a connector assembly of the type described above in which the housing walls defining the opening for receiving the male terminal comprise thin membrane portions thereof, with slits therein, which thin membrane portions are pushed aside when said male terminal is in an inserted position in said female terminal, thereby enabling full insertion of said male terminal.

A third object of the invention is a connector assembly of the type described in which the insulating housing overhangs the receiving end of the female terminal contained therein by a distance which enables the meeting of UL probe standards and in which said overhanging portion of said housing contains thin, slitted membranes which are folded aside in response to the shoulders of a male tab inserted in said female receptacle, said shoulders being abutting against the male receiving ends of the female terminal and thereby defining the proper insertion depth of the male terminal into the female terminal.

A fourth purpose of the invention is a connector assembly of the type described in which a portion of the insulating housing overhangs, i.e., extends beyond the male terminal receiving end edges of the female terminal contained therein by a distance which satisfies UL safety standards, with the overhanging portion of the housing containing thin slitted membrane sections which extend back from the receiving end edges of the overhanging portion rearwardly into said housing to a point slightly beyond the receiving end of the female terminal and to enable shoulders formed on the male terminal to abut against the receiving end edges of the female terminal, and thereby determining the insertion depth of the male terminal therein.

A fifth aim of the invention is the general improvement of housing assemblies of the type described above and which meet UL safety standards.

In accordance with one form of the invention a connector system comprises a male terminal and a female terminal with the female terminal being contained in a housing. In order to prevent accidental contact with said female terminal from an external source a portion of the housing is extended beyond the male receiving end of the female terminal and terminating in outer edges which form an opening for receiving said male terminal. The male terminal comprises an insertable portion having an industry standard length which mates by insertion into the female terminal, and a shoulder-like portion attached to said insertable portion with the shoulders fitting within a pair of oppositely positioned slotted sections in said housing. The said slotted sections extend from the outer edges of the extended portion of the housing back into the housing a predetermined distance and beyond the end edges of the female terminal to enable said shoulder-like portions to abut against the end edges of said female terminal, thereby determining the insertion depth of said male terminal into the female terminal.

In order to meet UL electrical isolation standards for said female terminal from accidental external contact when not mated to said male terminal, there are provided in the afore-mentioned slotted sections of the extended portion of the housing thin membranes which extend thereacross and which preferably are slitted to facilitate the folding back of said slotted thin membranes when said shoulders of the male terminal tab are inserted therein, thus enabling said shoulders when in their fully inserted position in said slots to abut against the end edges of said female terminal.

In accordance with a feature of the invention the membrane covered slotted sections of the housing can be rectangular in shape with the slit therein extending along the center of the membrane in the direction of insertion of the male terminal, or alternatively, a pair of slits on either side of the membrane sections also extending in the direction of insertion of the male tab and forming flaps of the thin membrane therebetween which fold back when said shoulders of the male tab abut against the end edges of the female terminal.

In accordance with another feature of the invention the configuration of the slotted section can be of many different shapes including triangular, parabolic or circular, with the wide portion thereof extending along the outer edge of the slotted portion of the housing. Slits can be formed in the thin membranes of different configurations to permit folding away of the sections of the slitted thin membranes when the male terminal is inserted in the female terminal and the shoulders of said male tab are abutting against the end edge of the female terminal to determine the depth of insertion of the male terminal therein.

BRIEF DESCRIPTION OF THE DRAWINGS

The above-mentioned and other objects and features of the invention will be more fully understood from the following detailed decription thereof when read in conjunction with the drawings in which.

DETAILED DESCRIPTION OF THE INVENTION

Figure 1:
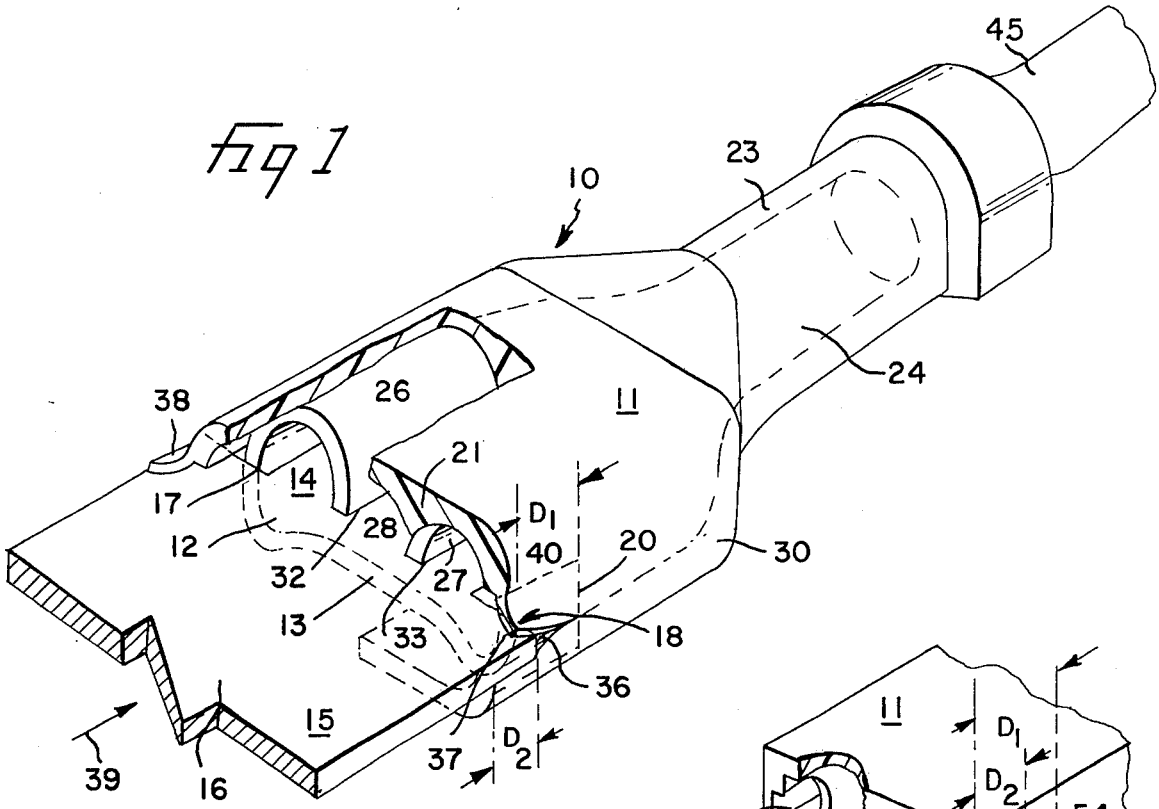
FIG. 1 is a perspective view of a connector employing the invention and including a housing with a female receptacle contained therein, and with portions of the housing broken away to more clearly show the relationship between the shoulders on the mated male terminal and the slitted, thin membrane covered slots formed in that portion of the housing which extends beyond the male receiving end edges of the female terminal and which receive the shoulders of the male terminal.

Referring now to FIG. 1 there is shown the assembly 10 of a female receptacle 12 contained in a housing 11 and a mating male terminal 15.

The housing 11 is comprised of a larger portion 30 which contains the female receptacle 12 and a smaller portion 23 which contains a wire receiving ferrule 24 shown in dotted lines.

The female terminal 12 consists of two bent-over portions 27 and 26 connected together by a transverse section 28. The male terminal 15 is comprised of an insertable portion 14 which is inserted into the female terminal 12 between the free longitudinal edges 32 and 33 of the bent-over portions 26 and 27.

The male terminal 15 also includes a wider tab portion 16 which narrows down into the insertable portion 14 by means of shoulders 17 and 18. The shoulders 17 and 18 abut against the outer end edge 13 of the female terminal 12 when the male terminal 15 is fully and properly inserted in the female terminal 12. The housing portion 30 extends or overhangs beyond the end 13 of the female terminal 12 by a distance $D_2$, which is a sufficient distance to prevent accidental contact with female terminal 12, when not connected to male terminal 15, with an external probe of a given size and configuration.

In order for the insertable portion 14 of the male terminal 15 to be fully inserted in female terminal 12 it is necessary that the shoulders 17 and 18 abut against the outer edge 13 of the female terminal 12. To provide for such abutment of shoulders 17 and 18 against said edge 13 of female terminal 12 there are provided thin, slitted membranes, such as membrane 40, formed in opposite walls of the housing 11. The thin membrane 40 is, in fact, a portion of the housing which is thinner than the remaining portion of the housing. In the embodiment shown in FIG. 1 the configuration of the thin membrane portion 40 is rectangular in nature as is indicated by reference character 20. A similar membrane 38 is formed on the other side of housing 11.

A slit 36 is cut through the membrane 40 in the same direction as the arrow 39, i.e., the direction of insertion of the male tab 15 into the female terminal 12. The shoulder 18 enters the slit 36 and forces the thin membrane 40 aside so that shoulder 18 abuts against the front edge 13 of female terminal 12. The membrane 40 and the slit 36 actually extend inwardly from the outer edge 21 of housing 11 inwardly towards the rear of the housing 11 to just beyond the back of the outer edge 13 of female terminal 12. Spefically, thin membrane 40 extends back from outer edge 21 of housing 11 a distance $D_1$ which distance can be seen in FIG. 1 to be greater than the distance $D_2$, which last mentioned distance $D_2$ is the amount of overhang of housing 11 beyond the outer edge 13 of female terminal 12.

Since the membrane 40 and the slit 36 therein extend back of the outer edge 13 of female terminal 12 the slitted membrane 40 does separate sufficiently to permit the abutting of shoulders 18 and 17 of tab 16 against the outer edge 13 of female terminal 12.

Upon withdrawal of male terminal 15 from female terminal 12 the folded away portions, such as portion 37 of slitted membrane 40, will tend to resume their original state to effectively insulate female terminal 12 from contact with external means, thereby meeting UL standards.

A conductor 45 is shown as being inserted into the metal ferrule 24 within the smaller end 23 of housing 11, although it does not in fact comprise a part of the invention.

Figure 2:
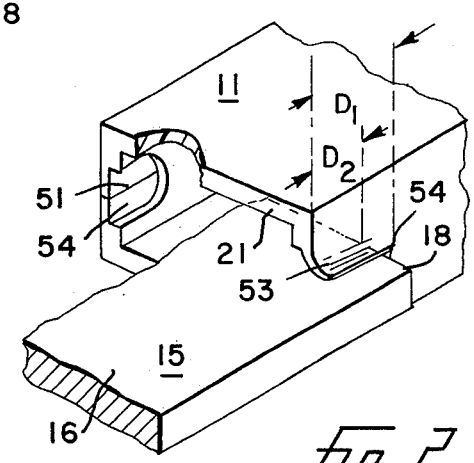
FIG. 2 is a perspective view of another form of the invention containing a different configuration of membrane-covered slots in the extended portion of the female terminal containing housing with one membrane shown receiving a male terminal shoulder and the other membrane not receiving a male terminal shoulder.

Referring now to FIG. 2 the thin membrane section 50 covers a slotted area having a semi-circular or semi-eliptical configuration with a slit 51 extending longitudinally down the center thereof. A similar, thin membrane in which a half portion thereof 53 is shown folded back by virtue of tab 15 being inserted therein. The end of the slit which defines the folded side portion 53 is denoted by reference character 54 and, as in the case of FIG. 1, extends beyond the shoulder 18 of the tab 16 to a point a distance $D_1$ back of the forward edge 21 of the housing 11. The distance $D_2$, as in the case of FIG. 1, represents the distance between the shoulder 18 and the leading edge of the female terminal (not shown in FIG. 2 but corresponding to leading edge 13 of FIG. 1) contained in housing 11 from the leading edge 21 of housing 11. It is to be noted that the shoulder 18 abuts against the forward edge of the female terminal contained within the housing 11 (in the manner shown in FIG. 1). The female terminal contained in the housing 11 of FIG. 2 is similar to the one shown in FIG. 1.

Figure 3:
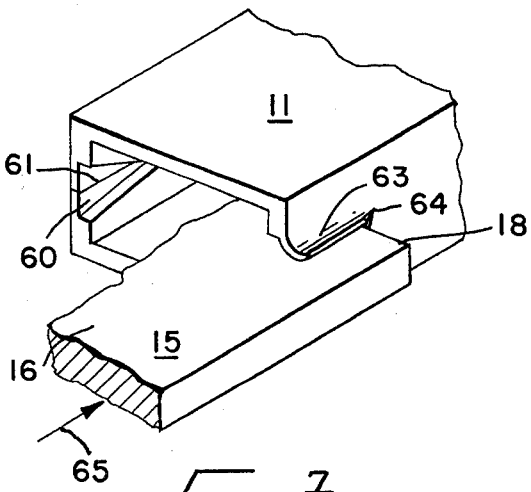
FIG. 3 is a perspective view of still another form of the membrane covered slots in the housing with a male terminal shoulder inserted in one of the membranes.

Referring now to FIG. 3 there is shown another configuration of the thin membrane designated by reference character 60. In FIG. 3 the thin membrane 60 is triangular in shape with a slit 61 extending along the center-line thereof in the direction of the arrow 65, i.e., the direction in which tab 15 is inserted in housing 11.

A similar, thin membrane of which one section 63 thereof is shown folded away by the partially shown inserted tab 15. The shoulder 18 of tab 60 again abuts against the front end edges of a female terminal contained in housing 11 (not shown specifically in FIG. 3, but similar to the one shown in FIG.1). The end of the slot defining the folded-over portion 63 is indicated by reference character 64 and extends beyond the shoulder 18 in much the same manner as that shown in FIGS. 1 and 2.

Figure 4:
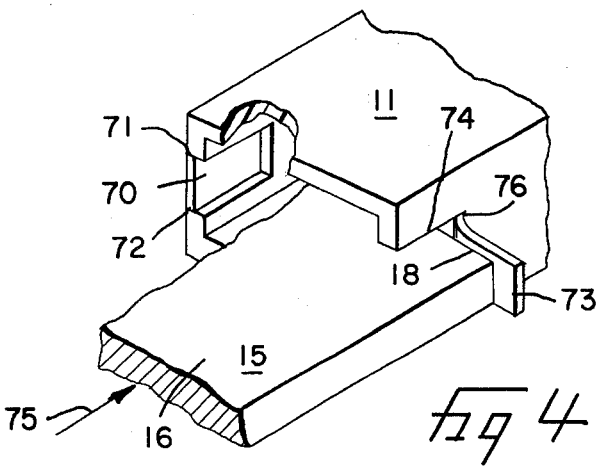
FIG. 4 is a perspective view of a fourth form of the invention showing a membrane with a pair of parallel slits formed therein and the folding away of one of the slitted membranes in response to the shoulder of an inserted male terminal.

Referring now to FIG. 4 there is shown thin, slitted membranes 70 and 73 with the partially shown tab 16 being inserted into the slot ordinarily covered by the folded back membrane 73. In FIG. 4 there are two slits extending along the length of each membrane in the direction of arrow 75. In membrane 70 these two slits are defined by reference characters 71 and 72 and extend along the edges of membrane 70. Slit 74 is shown adjacent the inserted tab 16 and defines the upper edge of folded back membrane 73.

As in the case of the structures of FIGS. 1, 2 and 3, the shoulder 18 of tab 16 abuts against the forward edge of a female terminal contained in the housing 11 (not shown in FIG. 4 but similar to the one shown in FIG. 1). The slits, such as slit 74, extend back of the tab shoulders, such as shoulder 18, and the outer edge of the female terminal contained in housing 11, and terminates at point 76.

In any of the structures shown in FIGS. 1 through 4, the thin membranes, which are forced out of the way by shoulder 18 to enable shoulder 18 to be abutted against the forward edge of the female terminal contained in housing 11, will spring back substantially to their initial position when the tab 16 is removed. The initial position is as shown by thin membranes 50, 60 and 70 in FIGS. 2, 3 and 4, respectively, for example, and provides electrical isolation for the female contact contained in housing 11 when said female terminal is not mated to a male connector 16.

Furthermore, in all of the structures shown in FIGS. 1 through 4, the slits can, under certain circumstances, be omitted. The circumstances are specifically that the membrane be thin enough so that it will rupture when a shoulder 18 is forced therein.

It is to be understood that the forms of the invention shown and described herein are but preferred embodiments thereof and that various modifications in design and configuration can be made without departing from the spirit or scope of the invention.

I claim:

1. A connector system comprising:

a male terminal having an insertable portion and a shoulder means;

a female terminal having outer edges defining an opening for receiving said insertable portion of said male terminal; and housing means constructed to retain said female terminal and comprising outer edges surrounding said opening in said female terminal and extending beyond said opening a predetermined distance;

said housing further comprising thin membrane portions extending from the outer edge of said housing to a point back of the outer edges of said female terminal and positioned to mate with the shoulder means of said male terminal;

said thin membrane portions having slits therein in the direction of insertion of said insertable portion of said male terminal into said female terminal to facilitate entry of said shoulder means into said thin membrane portions.

2. A connector system as in claim 1 in which said thin membrane portions comprise:

generally rectangularly-shaped major surfaces with one edge thereof being positioned substantially perpendicular to the direction of insertion of said insertable portion of said male terminal and along said point back of the outer edges of said female terminal; and at least one slit formed in each thin membrane portion and extending from the outer edge of said thin membrane portion back to a point near said one edge of said thin membrane portion.

3. A connector system as in claim 1 in which said thin membrane portions comprise:

generally triangularly-shaped major surfaces with one edge thereof being positioned substantially along the said outer edge of said housing means, and with the apex opposite said one edge being positioned coincident with said point back of the outer edge of said female conductor; and at least one slit formed in each of said thin membrane portions and extending from the said one edge of said thin membrane portion back to a point substantially coincident with said opposite apex of said thin membrane portion.

4. A connector system as in claim 1 in which said thin membrane portions comprise:

generally curvilinearly-shaped major surfaces with one edge thereof forming a portion of the said outer edge of said housing means and with the curvilinear portion extending back in said housing means to said point back of said outer edge of said female terminal; and at least one slit formed in each thin membrane portion and extending from the outer edge of said thin membrane portion back to substantially near said point.

5. A connector system comprising:

a male terminal having an insertable portion and shoulder means;

a female terminal having outer edges defining an opening for receiving said insertable portion of said male terminal and for engaging said shoulder means to determine the insertion depth of the insertable portion of said male terminal; and housing means constructed to retain said female terminal and comprising outer edges which surround said opening in said female terminal and extend beyond said opening a predetermined distance to provide for a predetermined degree of inacessability of said female contact;

said housing further comprising thin membrane portions extending from the outer edges of said housing to a point near the outer edges of said female terminal and positioned to mate with the shoulder means of said male terminal;

said thin membrane portions having slits thereon to facilitate entry of said shoulder means therein.

6. A connector system as in claim 5 in which said thin membrane portions comprise:

generally rectangularly-shaped major surfaces with one edge thereof being positioned substantially perpendicular to the direction of insertion of said insertable portion of said male terminal and along said point near the outer edges of said female terminal; and at least one slit formed in each thin membrane portion and extending from the outer edge of said thin membrane portion back to a point near said one edge of said thin membrane portion.

7. A connector system as in claim 5 in which said thin membrane portions comprise:

generally triangularly-shaped major surfaces with one edge thereof being positioned substantially along the said outer edge of said housing means, and with the apex opposite said one edge being positioned at said point near the outer edge of said female conductor; and at least one slit formed in each of said thin membrane portions and extending from the said one edge of said thin membrane portion back to a point substantially coincident with said opposite apex of said thin membrane portion.

8. A connector system as in claim 5 in which said thin membrane portions comprise:

generally curvilinearly-shaped major surfaces with one edge thereof forming a portion of the said outer edge of said housing means, and with the curvilinear portion extending back in said housing means to said point near said outer edge of said female terminal; and at least one slit formed in each thin membrane portion and extending from the outer edge of said thin membrane portion back to near said point.

9. In a connector system comprising a male terminal having an insertable portion and shoulder means and a female terminal having outer edges defining an opening for receiving said insertable portion of said male terminal and for engaging said shoulder means to determine the insertion depth of said male terminal, a housing means constructed to retain said female terminal;

said housing means comprising outer edges which surround said opening in said female terminal and which extend beyond said opening a predetermined distance to provide for a predetermined degree of inacessability of said female contact;

said housing further comprising thin membrane portions extending from the outer edge of said housing to a point back of the outer edges of said female terminal and positioned to coincide with the shoulder means of said male terminal;

said thin membrane portions having slits therein to facilitate entry of said shoulder means therein.

10. A connector system as in claim 9 in which said thin membrane portions comprise:

generally rectangularly-shaped major surfaces with one edge thereof being positioned substantially perpendicular to the direction of insertion of said insertable portion of said male terminal and along said point back of the outer edges of said female terminal; and at least one slit formed in each thin membrane portion and extending from the outer edge of said thin membrane portion back to a point near said one edge of said thin membrane portion.

11. A connector system as in claim 9 in which said thin membrane portions comprise:

generally triangularly-shaped major surfaces with one edge thereof being positioned substantially along the said outer edge of said housing means, and with the apex opposite said one edge being positioned near said point back of the outer edge of said female conductor; and at least one slit formed in each of said thin membrane portions and extending from the said one edge of said thin membrane portion back to a point substantially coincident with the said opposite apex of said thin membrane portion.

12. A connector system as in claim 9 in which said thin membrane portions comprise:

generally curvilinearly-shaped major surfaces with one edge thereof forming a portion of the said outer edge of said housing means, and with the curvilinear portion extending back in said housing means to said point back of said outer edges of said female terminal; and at least one slit formed in each thin membrane portion and extending from the outer edge of said thin membrane portion back to near said point.

13. In a connector system comprising a male terminal having an insertable portion and shoulder means, a female terminal having outer edges defining an opening for receiving said insertable portion of said male terminal and for engaging said shoulder means to determine the insertion depth of said male terminal, and a housing means constructed to retain said female terminal and comprising outer edges which surround said opening in said female terminal and which extend beyond said opening a predetermined distance;

thin membrane portions extending from the outer edge of said housing means back to a point near the outer edges of said female terminal and positioned to coincide with the shoulder means of said male terminal;

said thin membrane portions having slits thereon to facilitate entry of said shoulder means therein.

14. A connector system as in claim 13 in which said thin membrane portions comprise:

generally rectangularly-shaped major surfaces with one edge thereof being positioned substantially perpendicular to the direction of insertion of said insertable portion of said male terminal and along said point near the outer edges of said female terminal; and at least one slit formed in each thin membrane portion and extending from the outer edge of said thin membrane portion back to a point near said one edge of said thin membrane portion.

15. A connector system as in claim 13 in which said thin membrane portions comprise:

generally triangularly-shaped major surfaces with one edge thereof being positioned substantially along the said outer edge of said housing means, and with the apex opposite said one edge being positioned at said point near the outer edge of said female conductor; and at least one slit formed in each of said thin membrane portions and extending from the said one edge of said thin membrane portion back to a point substantially coincident with said opposite apex of said thin membrane portion.

16. A connector system as in claim 13 in which said thin membrane portions comprise:

generally curvilinearly-shaped major surfaces with one edge thereof forming a portion of the said outer edge of said housing means, and with the curvilinear portion extending back in said housing means to said point near said outer edge of said female terminal; and at least one slit formed in each thin membrane portion and extending from the outer edge of said thin membrane portion back to a point near said point.

17. In a connector system comprising a male terminal having an insertable portion and shoulder means, a female terminal having outer edges defining an opening for receiving said insertable portion of said male terminal and for engaging said shoulder means to determine the insertion depth of said male terminal, and a housing means constructed to retain said female terminal and comprising outer edges which surround said opening in said female terminal and which extend beyond said opening a predetermined distance;

thin membrane portions extending from the outer edge of said housing means back to a point near the outer edges of said female terminal and positioned to coincide with the shoulder means of said male terminal.

* * * * *

UNITED STATES PATENT OFFICE
CERTIFICATE OF CORRECTION

PATENT NO. : 3,989,346

DATED : November 2, 1976

INVENTOR(S) : RANDY MARSHALL MANNING

It is certified that error appears in the above-identified patent and that said Letters Patent are hereby corrected as shown below:

Column 6, line 53, after "male terminal" insert - - - in said female terminal - - - .

Signed and Sealed this

Fourth Day of January 1977

[SEAL]

*Attest:*

RUTH C. MASON
*Attesting Officer*

C. MARSHALL DANN
*Commissioner of Patents and Trademarks*